US011691040B2

(12) United States Patent
Guiberti et al.

(10) Patent No.: US 11,691,040 B2
(45) Date of Patent: Jul. 4, 2023

(54) FLAME ARRESTOR

(71) Applicants: The Boeing Company, Chicago, IL (US); King Abdullah University of Science and Technology, Thuwal (SA)

(72) Inventors: Thibault F. Guiberti, Thuwal (SA); Jason Scott Damazo, Seattle, WA (US); Eddie Kwon, Seattle, WA (US); Deanna A. Lacoste, Thuwal (SA); William L. Roberts, Thuwal (SA)

(73) Assignees: The Boeing Company, Chicago, IL (US); King Abdullah University of Science and Technology, Thuwal (SA)

( * ) Notice: Subject to any disclaimer, the term of this patent is extended or adjusted under 35 U.S.C. 154(b) by 582 days.

(21) Appl. No.: 16/442,175

(22) Filed: Jun. 14, 2019

(65) Prior Publication Data

US 2020/0215366 A1 Jul. 9, 2020

Related U.S. Application Data

(60) Provisional application No. 62/789,756, filed on Jan. 8, 2019.

(51) Int. Cl.

| | |
|---|---|
| ***A62C 3/08*** | (2006.01) |
| ***A62C 2/06*** | (2006.01) |
| ***A62C 4/02*** | (2006.01) |
| *F17D 1/02* | (2006.01) |

(52) U.S. Cl.

CPC ..... *A62C 4/02* (2013.01); *A62C 2/06* (2013.01); *F17D 1/02* (2013.01)

(58) Field of Classification Search

CPC ..... A62C 2/06; A62C 3/08; A62C 4/02

See application file for complete search history.

(56) References Cited

U.S. PATENT DOCUMENTS

| | | | | |
|---|---|---|---|---|
| 4,192,658 | A | 3/1980 | Worrell | |
| 7,128,032 | B2 * | 10/2006 | Froeschle | H02K 41/031 123/90.11 |
| 2016/0135448 | A1 * | 5/2016 | Nevo | G01N 1/04 435/286.1 |
| 2016/0136464 | A1 | 5/2016 | Strybos | |
| 2016/0136466 | A1 | 5/2016 | Strybos | |
| 2017/0259098 | A1 * | 9/2017 | Tran | G10K 11/26 |

FOREIGN PATENT DOCUMENTS

| | | | |
|---|---|---|---|
| EP | 3081266 | A2 | 10/2016 |
| GB | 2344049 | A | 5/2000 |
| RU | 169033 | U1 | 3/2017 |
| RU | 2657692 | C1 | 6/2018 |

OTHER PUBLICATIONS

GCC Patent Office, Examination and Search Report, dated Mar. 5, 2021, regarding Application No. GC2020-40032, 7 pages.

Extended European Search Report, dated Jun. 9, 2020, regarding Application No. EP19212276, 7 pages.

* cited by examiner

*Primary Examiner* — Paul J Gray

(74) *Attorney, Agent, or Firm* — Yee & Associates, P.C.

(57) ABSTRACT

A method, system, and apparatus for flame arresting are provided. In an embodiment, a flame arrestor includes a quenching element disposed within a conduit. The flame arrestor also includes a cooling system in thermal contact with the quenching system. The cooling system cools the quenching element during operation of the cooling system.

20 Claims, 9 Drawing Sheets

FLAME ARRESTOR

CROSS-REFERENCE TO RELATED CASE(S)

This application claims the benefit of U.S. Provisional Application Ser. No. 62/789,756, filed Jan. 8, 2019, entitled "Flame Arrestor", which is incorporated herein by reference in its entirety.

BACKGROUND INFORMATION

1. Field

The disclosure relates generally to control of flammable fluids and more specifically to flame arrestors.

2. Background

A flame arrestor is a device that stops fuel combustion by extinguishing the flame. Flame arrestors are used to stop the spread of an open fire, to limit the spread of an explosive even that has occurred, to protect potentially explosive mixtures from igniting, to confine fire within an enclosed, controlled, or regulated location, and to stop the propagation of a flame. Flame arrestors are commonly used in fuel storage tank vents, fuel gas pipelines, and other areas. One problem with prior art flame arrestors is that they have a high density of quenching elements in order to quench the flame. However, the high density of quenching elements reduces the flow of fluid through a pipe as well as adds weight.

Therefore, it would be desirable to have a method and apparatus that take into account at least some of the issues discussed above, as well as other possible issues. For example, it would be desirable to have a method and apparatus that overcome a technical problem with fluid flow and weight in a flame arrestor.

SUMMARY

In one illustrative embodiment, a flame arrestor is presented. The flame arrestor includes a quenching element disposed within a conduit. The flame arrestor also includes a cooling system in thermal contact with the quenching system. The cooling system cools the quenching element during operation of the cooling system.

In another illustrative embodiment, a flame arrestor is presented. The flame arrestor includes a fluid transport pipe for transporting a combustible fluid from a first point to a second point. The flame arrestor also includes a quenching element disposed within an inner volume of the fluid transport pipe. The quenching element is at least partially constructed from a flame arresting material. The flame arrestor also includes a cooling element in thermal contact with the quenching element. The cooling element is configured to cool the quenching element below a threshold temperature.

In yet another illustrative embodiment, a method for arresting a flame in a pipe carrying a combustible fluid is presented. The method includes directing the combustible fluid through a quenching element disposed within the pipe. The method also includes cooling the quenching element with a cooling element in thermal contact with the quenching element. The quenching element is cooled below a threshold temperature.

In another illustrative embodiment, a vehicle is provided. The vehicle includes a vehicle frame structure and a fluid housing conduit within the vehicle frame structure. The fluid housing conduit configured to be at least partially filled with a combustible fluid. The vehicle also includes a quenching element disposed within an inner chamber of the fluid housing conduit. The quenching element includes a flame arresting material. The vehicle also includes a cooling element thermally coupled to the quenching element to maintain a temperature of the quenching element below a threshold temperature.

DETAILED DESCRIPTION

Figure 1:
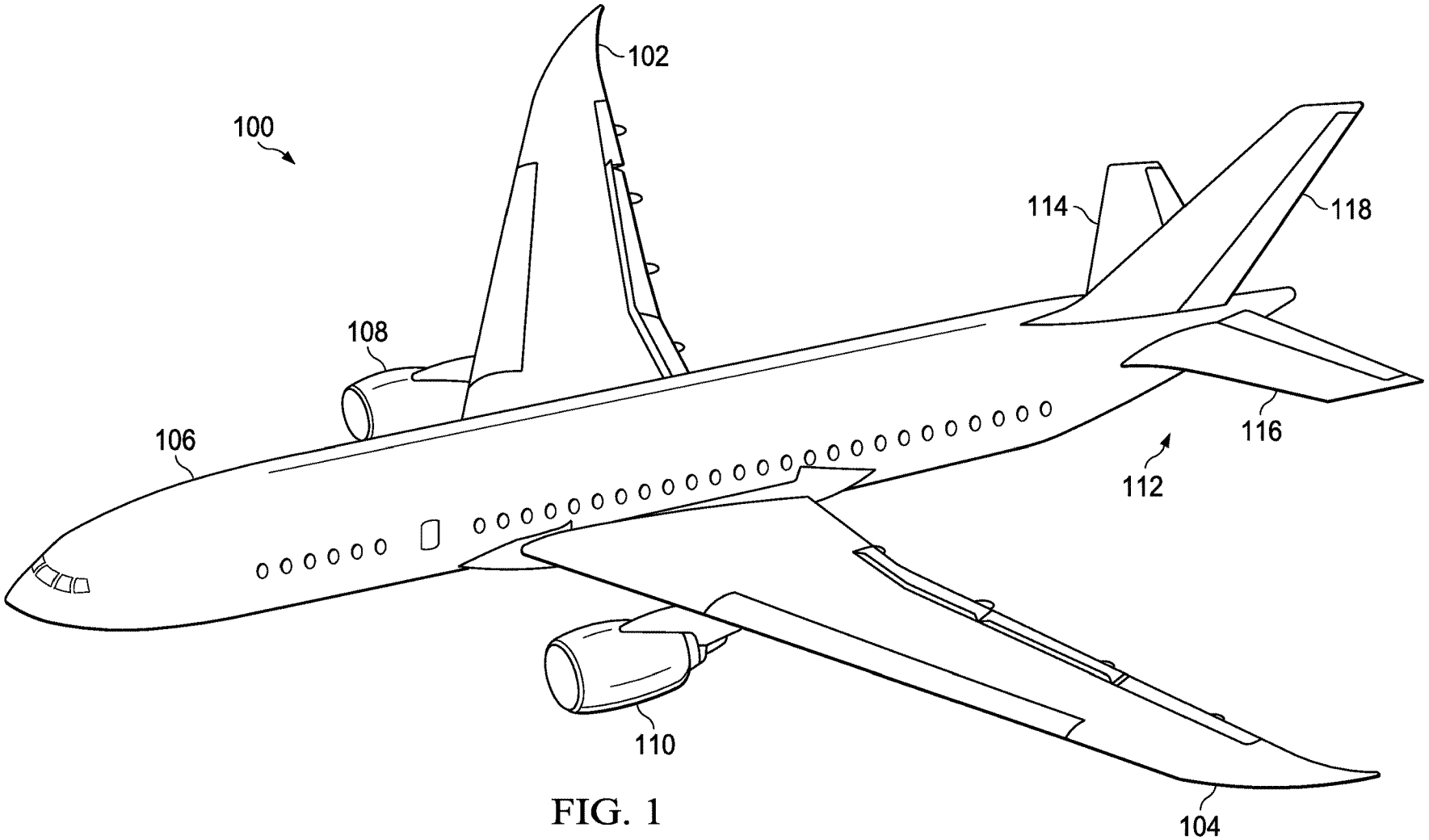
FIG. 1 is an illustration of an aircraft in which an illustrative embodiment may be implemented.

The different illustrative embodiments recognize and take into account one or more different considerations. For example, the illustrative embodiments recognize and take into account that conduits carrying flammable fluids often require flame arrestors to quench a flame thereby preventing a flame from propagating beyond a particular point in the conduit. Additionally, the illustrative embodiments recognize and take into account that in many applications, a flame arrestor may be desirable to have a reduced surface area such that the flow of a fluid through a conduit is not significantly impeded and that little or no pressure drop is experienced by the fluid as it traverses through the flame arrestor. The illustrative embodiments recognize and take into account that the weight is a significant issue in some applications, such as for use in aircraft. Thus, illustrative embodiments provide a flame arrestor that has a reduced weight as compared to prior art flame arrestors while providing equivalent flame arresting. In other embodiments, a flame arrestor having a weight, similar to a prior art flame arrestor, provides improved flame arresting as compared to the prior art.

Understanding flame quenching is beneficial in developing efficient flame arrestors and to increase the safety of practical combustion systems, such as aircrafts. It is an insight of this disclosure that inflight, pressure and temperature are much different than at sea level with typically: $T<220$ K and $P<25{,}000$ Pa. While effects of pressures below atmospheric on flame quenching distance are known, there are no data available for temperatures below $T=300$ K. One goal of this disclosure is to fill this gap. In an embodiment, this is done by measuring the quenching distance of methane-air laminar flames in the canonical head-on configuration, where the temperature of the quenching plate is adjusted between T=175 and 300 K. Temperature is adjusted using liquid nitrogen and is monitored with a thermocouple. The quenching distance is measured by recording the transient quenching event with a high-speed camera targeting OH* chemiluminescence. The setup and methods are first validated by measuring the quenching distance at T=300 K and different equivalence ratios and comparing values to that available in the literature. Then, the quenching distance is measured for T=175 to 300 K. It is an insight of this disclosure that the quenching distance decreases linearly with temperature decrease and is divided by two over the temperature range examined.

In another embodiment, the quenching distance of methane-air laminar flames is measured in the canonical head-on configuration, where the temperature of the quenching plate is adjusted between T=175 and 300 K. Temperature is adjusted using liquid nitrogen and is monitored with a thermocouple. The quenching distance is measured by recording the transient quenching event with a high-speed camera targeting OH* chemiluminescence. The setup and methods are first validated by measuring the quenching distance at T=300 K and different equivalence ratios and comparing values to that available in the literature. Then, the quenching distance is measured for T=175 to 300 K. The quenching distance decreases with temperature increase over the temperature range examined.

Disclosed herein are flame arrestors and methods and systems for arresting flames in a fluid conduit. In an aspect, a method for arresting a flame includes cooling of the quenching surface down to very low temperatures. In some embodiments, the quenching surface is cooled down to cryogenic temperatures. In an embodiment, a flame arrestor includes a quenching element disposed within a conduit for propagating the flow of a combustible fluid. The quenching element is in thermal contact with a cooling element that cools the quenching element sufficiently such that a flame does not propagate past some specified point. In other words, the flame is extinguished before the flame can propagate past some specified point either within the flame arrestor or a certain distance from the end of the flame arrestor. In some embodiments, the quenching element is cooled sufficiently such that the combustible fluid maintains a temperature below its combustion temperature.

In an illustrative embodiment, a method for arresting a flame in a pipe carrying a combustible fluid includes directing the combustible fluid through a quenching element disposed within the pipe; and cooling the quenching element with a cooling element in thermal contact with the quenching element, the quenching element cooled below a threshold temperature. In an illustrative embodiment, the cooling the quenching element includes providing a flow of cool fluids through the cooling element to extract heat from the quenching element. In an illustrative embodiment, the cool fluids are selected from one of liquid nitrogen, liquid helium, and cold air. In an illustrative embodiment, cooling the quenching element includes removing heat from the cooling elements via a thermoelectric Peltier cooler. In an embodiment, the cooling of the quenching element includes immersing the cooling element in ice or an ice water mixture. In an illustrative embodiment, the quenching element includes an inner surface of the pipe through which the combustible fluid flows.

The disclosed embodiments of a flame arrestor may be used in a pipe or conduit as described in more detail below. In some embodiments, the conduit is a container for containing flammable fluids such as fuel (e.g., a fuel tank).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer-readable program instructions.

Referring now to the figures and, in particular, with reference to FIG. 1, an illustration of an aircraft is depicted in which an illustrative embodiment may be implemented. In this illustrative example, aircraft 100 has wing 102 and wing 104 connected to body 106. Aircraft 100 includes engine 108 connected to wing 102 and engine 110 connected to wing 104.

Body 106 has tail section 112. Horizontal stabilizer 114, horizontal stabilizer 116, and vertical stabilizer 118 are connected to tail section 112 of body 106.

Aircraft 100 is an example of an aircraft having parts that may be inspected using a laser inspection system connected to a robotic arm, connected to a base of a crane system. For example, during manufacturing, components of at least one of wing 102, wing 104, body 106, or tail section 112 may be inspected using the described method and system for automated data collection and part validation.

Aircraft 100 may include fuel lines, hydraulic lines, and other conduits (not shown) that carry flammable fluids such as fuel, hydraulic fluid, or a lubricant such as engine oil. Disclosed embodiments of the flame arrestor described in more detail below may be used in or in conjunction with these conduits. In an embodiment, a vehicle frame structure includes a fluid housing component that is at least partially filled with a combustible fluid or configured to be at least partially filled with a combustible fluid, a quenching element disposed within an inner chamber of the fluid housing component, and a cooling element thermally coupled to the quenching element to maintain a temperature of the quenching element below a threshold temperature. The vehicle may be, for example, one of an airplane, a helicopter, a space capsule, a satellite, an automobile, a train, a ship, and a submarine. The threshold temperature may be a temperature sufficiently cold to prevent combustion of the flammable liquid or to prevent a flame produced by the flammable liquid from propagating through the fluid housing component beyond a certain point. In an embodiment, the cooling element maintains a temperature of the quenching element below a combustion temperature of the combustible fluid. In some embodiments, the threshold temperature may simply be some temperature below ambient temperature. In an embodiment, the threshold temperature is determined according to one or more properties of the combustible fluid.

As used herein, "a number of" when used with reference items, means one or more items. For example, "a number of different types of networks" is one or more different types of networks.

Further, the phrase "at least one of," when used with a list of items, means that different combinations of one or more of the listed items may be used, and only one of each item in the list may be needed. In other words, "at least one of" means any combination of items and any number of items may be used from the list, but not all of the items in the list are required. The item may be a particular object, a thing, or a category.

For example, without limitation, "at least one of item A, item B, or item C" may include item A, item A and item B, or item B. This example also may include item A, item B, and item C or item B and item C. Of course, any combinations of these items may be present. In some illustrative examples, "at least one of" may be, for example, without limitation, two of item A; one of item B; and ten of item C; four of item B and seven of item C; or other suitable combinations.

This illustration of aircraft 100 is provided for purposes of illustrating one environment in which the different illustrative embodiments may be implemented. The illustration of aircraft 100 in FIG. 1 is not meant to imply architectural limitations as to the manner in which different illustrative embodiments may be implemented. For example, aircraft 100 is shown as a commercial passenger aircraft. The different illustrative embodiments may be applied to other types of aircraft, such as a private passenger aircraft, a rotorcraft, or other suitable types of aircraft.

Although the illustrative examples for an illustrative embodiment are described with respect to an aircraft, the illustrative embodiments may be applied to other types of structures. The structure may be, for example, a mobile structure, a stationary structure, a land-based structure, an aquatic-based structure, or a space-based structure. More specifically, the structure may be a surface ship, a tank, a personnel carrier, an automobile, a train, a spacecraft, a space station, a satellite, a submarine, a manufacturing facility, a building, or other suitable structures.

Figure 2:
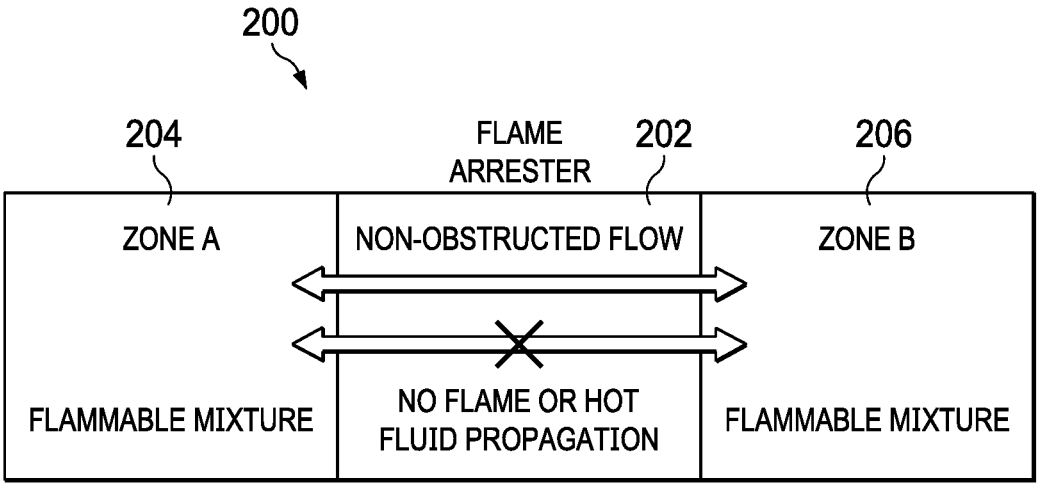
FIG. 2 is an illustration of a block diagram of a flame arrestor in accordance with an illustrative embodiment.

FIG. 2 is a block diagram of an illustrative embodiment of a flame arrestor 202. Typically, flame arrestors are passive devices used to stop the propagation of fires or uncontrolled flames. Flame arrestors are placed between two zones filled with flammable fluids, such as flammable gas mixtures. Thus, for example, a flame arrestor 202 is disposed within a conduit 200 between zone A 204 and zone B 206. The flame arrestor 202 prevents the propagation of a fire or a flame from zone A 204 to zone B 206 and vice versa. However, the flame arrestor remains permeable to the flow of flammable fluids (i.e., gases and/or liquids) which can freely transit between zone A 204 and zone B 206. Thus, the flame arrestor 202 stops the combustion front from reaching zone A 204 or zone B 206 and also avoids propagation of any ignition source to the other zone, such as hot jets or chemically active gases, while flow of inherently safe fluids is not impeded.

Usually, flame arrestor technologies are based on the principle that hot reactive flows, referred to herein as flames, or combustion products loose heat to surrounding solid surfaces that are at ambient temperature. Practically, flames cannot sustain and propagate in cavities whose dimensions are smaller than a quenching distance, function of the fuel and the fuel-air ratio. Similarly, the hot combustion products of the flame become inherently safe as they travel through the cavity because they are cooled down due to convective heat transfers with solid surfaces at ambient temperature.

It is an insight of this disclosure that the quenching distance of a flame interacting with a solid surface increases when the solid surface temperature is decreased.

Figure 3:
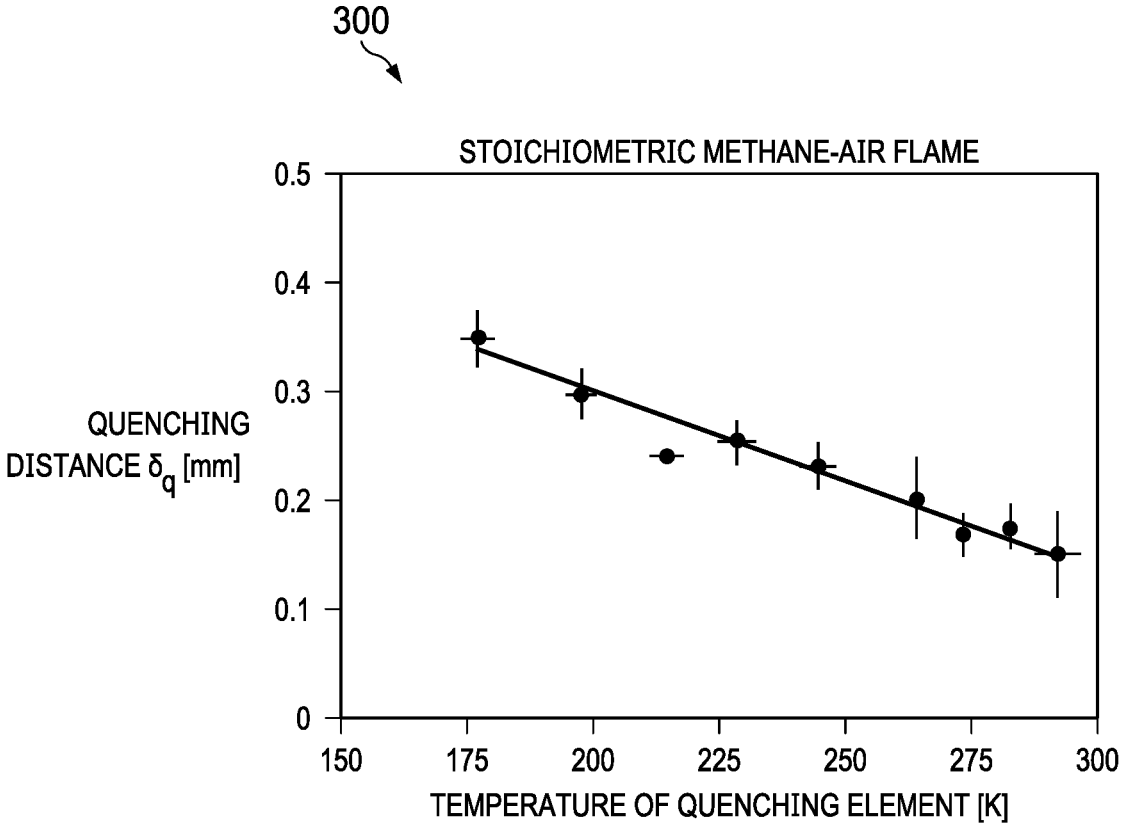
FIG. 3 is an illustration of a graph of temperature of a quenching element versus the quenching distance for a stoichiometric methane-air flame in accordance with an illustrative embodiment.

FIG. 3 is a graph 300 of a temperature of a quenching element versus the quenching distance for a stoichiometric methane-air flame according to an illustrative embodiment. As shown in FIG. 3, the quenching distance $\delta_q$ of a stoichiometric methane-air flame, at atmospheric pressure, increases by a factor of 2 when the temperature of the quenching element is decreased from ambient (20° C.) to 200 K (−73° C.).

Figure 4:
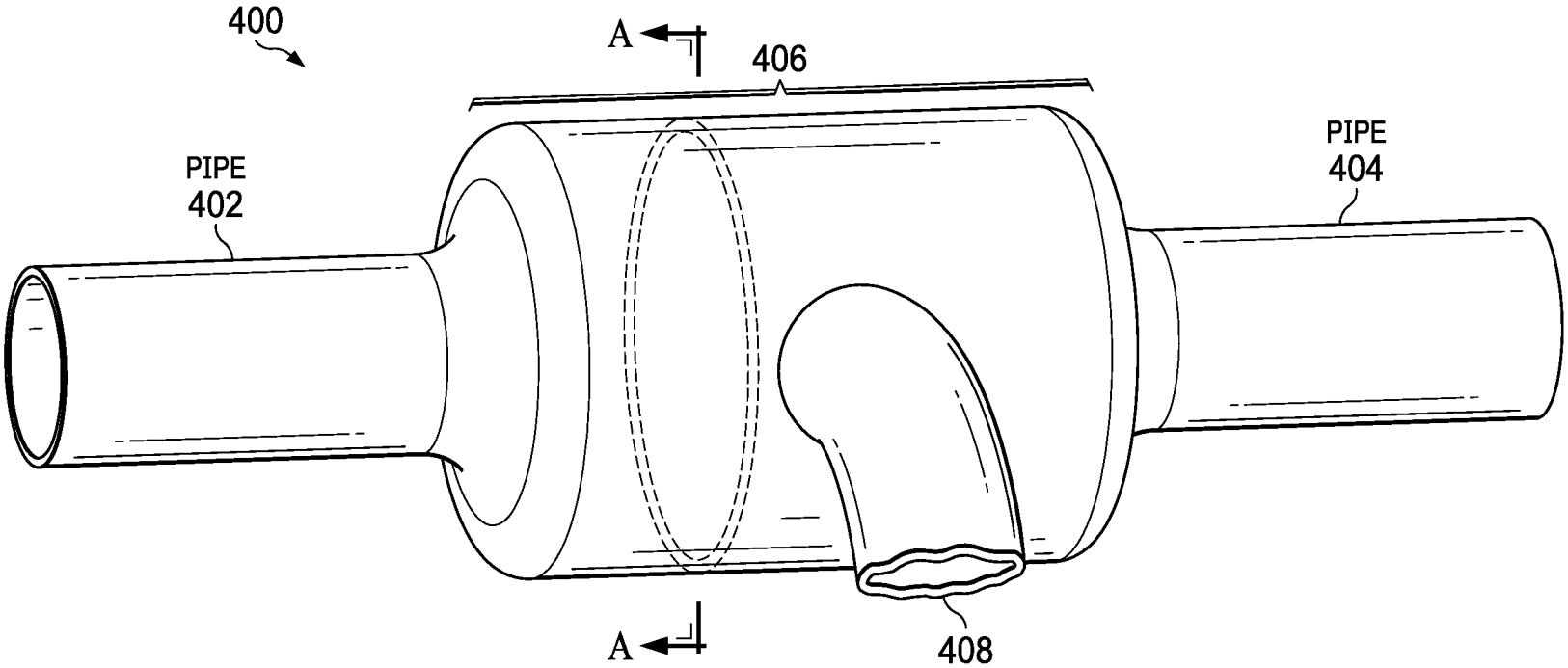
FIG. 4 is an illustration of a diagram of a flame arrestor in accordance with an illustrative embodiment.

FIG. 4 is a diagram of an illustrative embodiment of a flame arrestor 400. Flame arrestor 400 includes an entrance pipe 402 and an exit pipe 404 with a flame arrestor chamber 406 disposed between the pipes 402, 404. A flammable fluid may flow through the flame arrestor 400 from entrance pipe 402 through the flame arrestor chamber 406 and exiting through the exit pipe 404. The flame arrestor chamber 406 includes quenching elements (not shown) and a cooling element (not shown) for cooling the quenching elements of the flame arrestor 400 during operation of the cooling system. The quenching elements are disposed within the flame arrestor chamber 406 and are in thermal contact with the cooling system. In an embodiment, the pipes 402, 404 and the flame arrestor chamber 406 have the same diameter and the quenching element is disposed within the pipe or conduit. In an embodiment, flame arrestor 400 also includes a cooling element conduit 408 for providing a cooling fluid to the cooling element and/or electrical connections to connect the cooling element to an external power supply if cooling is accomplished via thermoelectric cooling Peltier devices. Heat extracted from the quenching elements by the cooling element may be removed from the flame arrestor 400 via the cooling element conduit 408. In an embodiment, the cooling element includes an apparatus for providing a chemical endothermic reaction of two or more chemical agents. In an embodiment, the cooling element is a Joule-Thomson effect cooler.

The cooling of the flame arrestor quenching elements can be made by any number of cooling systems including, for example, by a flow of liquid nitrogen, by a flow of cold fluid such as air or water, by a refrigeration system including those based on thermoelectric Peltier effect (e.g., cooling by applying a voltage difference at the junction between two conductive materials), or naturally, by immersing the flame arrestor chamber 406 in a cold environment such as ice, an ice-water mixture, high-altitude atmosphere, or the vacuum of empty space. The cooling of the flame arrestor quenching elements may also be performed by a sudden mixing of two chemical agents that would produce an endothermic reaction. For example, dissolution of salt in a solvent is typically an endothermic process (ammonium in water, potassium chloride in water, sodium carbonate in ethanoic acid, etc.). In yet another embodiment, the cooling of the flame arrestor quenching elements may be performed using the Joule-Thomson effect (i.e., rapid adiabatic gas expansion).

In an embodiment, the quenching element has channels in which walls of the channels have a number of dimensions and a temperature that are selected to reduce a temperature of a combustible fluid below an ignition temperature of the combustible fluid. In an embodiment, the number of dimensions includes a distance between opposing walls of a channel and that distance reduces the temperature of a combustible fluid below the ignition temperature of the combustible fluid where the distance is selected based on a quenching distance determined using a cooled temperature of the quenching element. In an embodiment, the cooled temperature of the quenching elements is a cryogenic temperature. In an embodiment, a cryogenic temperature is a temperature at or below −150° C.

In an embodiment, the cooling system is selected from a group consisting of at least one of an active cooling system, a passive cooling system, a thermoelectric cooler (also referred to as a thermoelectric Peltier cooler), a water cooler, an air cooler, or a liquid nitrogen cooler.

In an embodiment, the pipes 402, 404 (also referred to as a conduit of a fluid transport pipe) are part of a fluid transport system that transports fluids. The fluids may be, for example, a fuel, gasoline, kerosene, methane, ethane, propane, butane, ethylene, hydrogen, acetylene, ammonia, carbon monoxide, syngas, ethanol, methanol, propanol, dimethoxyethane (DME), and oxygen. In an embodiment, the fluids may be a flammable fluid including both flammable gasses and flammable liquids. For example, the fluids may be a fuel, a gasoline, kerosene, methane, ethane, propane, butane, ethylene, hydrogen, acetylene, ammonia, carbon monoxide, syngas, ethanol, methanol, propanol, DME, and oxygen. The fluids may be a mixture of two or more substances. In some embodiments, the fluids may include both a liquid and a gas.

In an embodiment, the quenching elements are disposed within an inner volume of the fluid transport pipe and the quenching element is fabricated at least partially from a flame arresting material. The flame arresting material may be a metal, a ceramic, or a plastic. The metal may be, for example, one of aluminum, stainless steel, Inconel, iron, copper, brass, bronze, and titanium. Plastics may include polyamides, polycarbonates, polyethylenes, polypropylenes, polyvinyl-chloride, and acrylonitrile-butadiene styrene. Other materials may be used for the flame arresting material. The flame arresting material should be a solid at the temperatures anticipated to be present in the flame arrestor. In an embodiment, the flam arresting materials are materials that are solids at the combustion temperature of the fluid flowing through the conduit. In an embodiment, the quenching elements include a plurality of quenching element tubes wherein each of the quenching element tubes includes an opening for the fluid to flow through and the opening has a diameter greater than or equal to 1 millimeter (mm). In an embodiment, the quenching elements are a single quenching element. In an embodiment, the single quenching element is an inner surface of the fluid transport pipe.

In an embodiment, the cooling element surrounds a portion of the pipes. In an embodiment, the cooling element is integrated as at least a portion of a wall of the fluid transport pipe. In an embodiment, the cooling element is a hollow component filled or partially filled with cool fluids or a cooling fluid that flows through the cooling element to extract heat from the quenching element, thereby cooling the quenching element. The cooling fluid may be a gas or a liquid. In an embodiment, the gas may be air. In embodiment, the liquid is a cryogenic liquid such as liquid nitrogen or liquid helium. In an embodiment, the cooling element includes one or more thermoelectric Peltier coolers. In an embodiment, the cooling element includes a plurality of reservoirs each storing a respective chemical agent that when mixed together inside the cooling element near to the quenching elements produce an endothermic reaction thereby cooling the quenching elements. Dissolution of salt in a solvent is typically an endothermic process. Examples of substances which when combined produce an endothermic reaction include ammonium in water, potassium chloride in water, and sodium carbonate in ethanoic acid. In another embodiment, the cooling element includes a cooling system implementing the Joule-Thomson effect to cool the quenching elements by rapid adiabatic gas expansion.

In an embodiment, the cooling element encases or is encased in a refrigerating solution such as an ice water mixture. In an embodiment, the cooling element is a deformable material. In an embodiment, the cooling element includes a tube or tubes for a cooling fluid to circulate around at least a portion of the quenching elements having a surface exposed to the cooling element and for the fluid to flow away from the quenching elements through a heat exchanger to dissipate heat removed from the quenching elements.

Some benefits of one or more embodiments of the disclosed flame arrestors as compared to conventional flame arrestors are a decrease in the pressure loss the flame arrestor will induce on any flowing fluid (pressure loss scales with the inverse of the quenching element's characteristic dimension to the power of 5). Other benefits of one or more embodiments of the disclosed flame arrestors are a weight reduction of the flame arrestor associated with the decrease of the required functional quenching surface area. Another benefit of one or more embodiments of the disclosed cooling element is that a separate flame arrestor part may be eliminated altogether if the conduit's diameter is sufficiently small enough to quench flames itself. Thus, in these embodiments, the inner wall of the conduit is the flame arrestor and this inner wall is the quenching element. The disclosed cooling element increases the allowable diameter of an inherently safe conduit.

One application of the disclosed devices, methods, and systems is the control of fire and/or flame propagation in systems that require a large flow rate (and, as a consequence, small pressure losses through the flame arrestor) and/or that are weight sensitive. The disclosed embodiments allow reduction of detrimental pressure losses compared to prior art conventional flame arrestors and provide for a comparable flame quenching efficiency. This allows for a reduction in the functional quenching surface area of the quenching elements leading to weight savings. Flame arrestors are of interest for mitigation of fire and/or flame related hazard for any device that is weight sensitive such as planes, helicopters, drones, or satellites or that requires large flow rates with minimal pressure loss, such as for fuel injection systems or fuel pipes.

Turning now to FIGS. 5-8, cross sectional views of the flame arrestor 400 showing different configurations of the quenching elements are depicted in accordance with illustrative embodiments. The cross sectional views in FIGS. 5-8 are taken at cross section A in FIG. 4.

Figure 5:
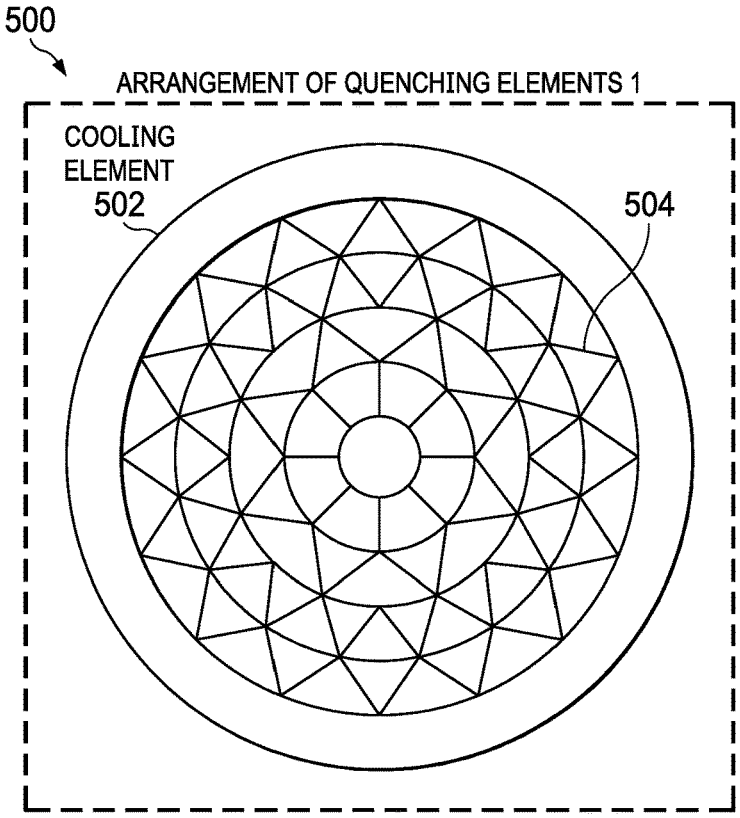
FIGS. 5-8 are illustrations of cross-sectional views of the flame arrestor showing different configurations of the quenching elements in accordance with an illustrative embodiment.

FIG. 5 shows a flame arrestor 500 with cooling element 502 surrounding a plurality of quenching elements 504. The flame arrestor 500 may be implemented as flame arrestor 400 depicted in FIG. 4. The quenching elements 504 include variously shaped quenching elements that are not all uniformly shaped. The quenching elements 504 are arranged in a fashion similar to a kaleidoscope with some elements having triangular like shapes and other elements having a wedge like shape and still other elements having a polygon like shape. The surfaces of each quenching element 504 extend longitudinally through the flame arrestor 400 such that fluid flows through pipe 402 and into pipe 404 through the quenching elements 504.

Figure 6:
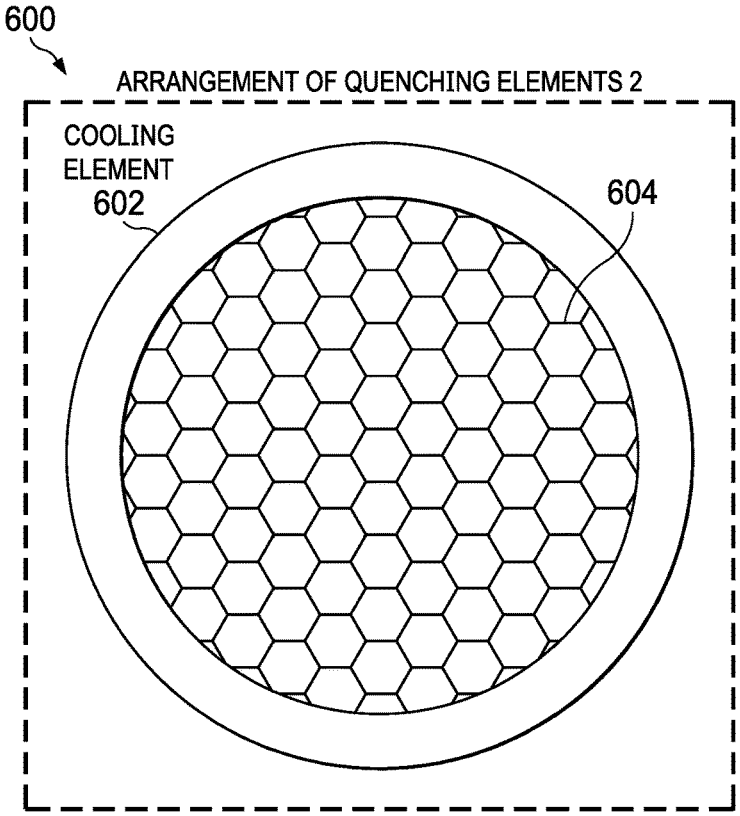

FIG. 6 shows a flame arrestor 600 with cooling element 602 surrounding a plurality of quenching elements 604. The flame arrestor 600 may be implemented as flame arrestor 400 depicted in FIG. 4. The quenching elements 604 are mostly uniform in shape and size, although variations in shape and size are allowable. The quenching elements 604 are generally polygonal in shape. The surfaces of each quenching element 604 extend longitudinally through the flame arrestor 400 such that fluid flows through pipe 402 and into pipe 404 through the quenching elements 604.

Figure 7:
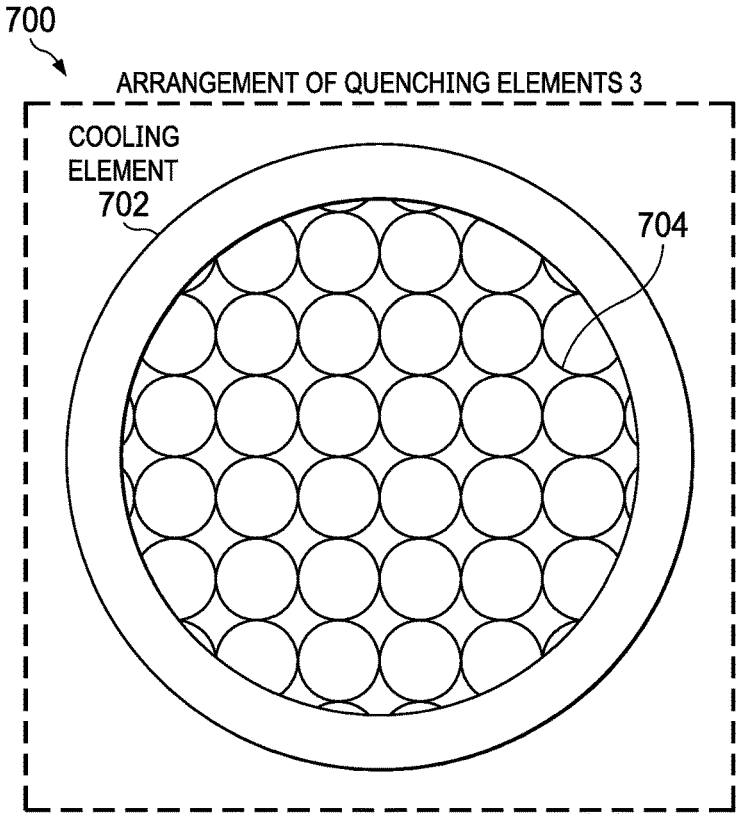

FIG. 7 shows a flame arrestor 700 with cooling element 702 surrounding a plurality of quenching elements 704. The flame arrestor 700 may be implemented as flame arrestor 400 depicted in FIG. 4. The quenching elements 704 are mostly uniform in shape and size, although, as with flame arrestor 600, variations in shape and size are allowable. The quenching elements 704 are generally circular in shape with some neighboring quenching elements 704 touching and others separated by a small gap formed by the joining of four neighboring quenching elements 704. The surfaces of each quenching element 704 extend longitudinally through the flame arrestor 400 such that fluid flows through pipe 402 and into pipe 404 through the quenching elements 704.

Figure 8:
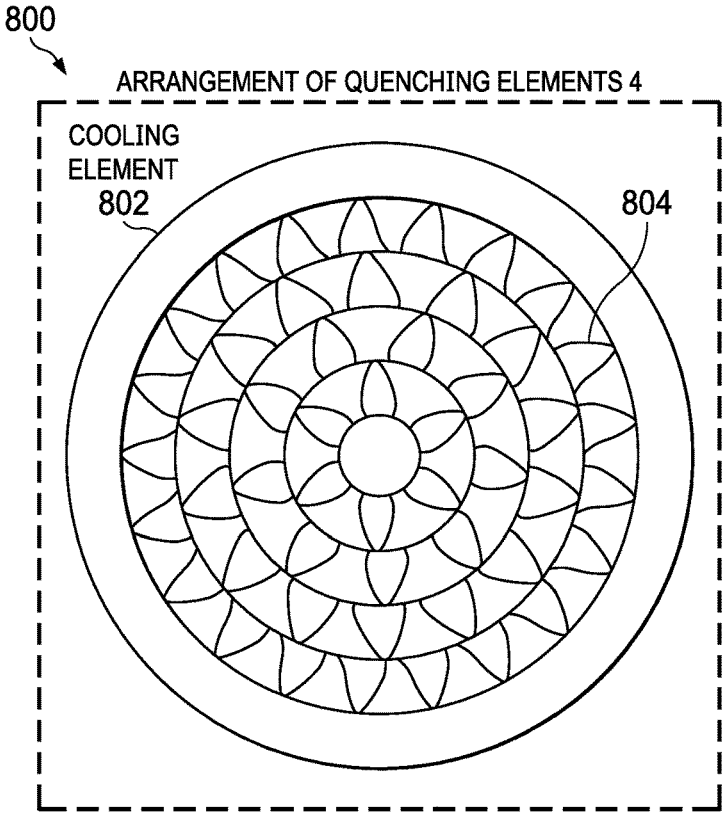

FIG. 8 shows a flame arrestor 800 with cooling element 802 surrounding a plurality of quenching elements 804. The flame arrestor 800 may be implemented as flame arrestor 400 depicted in FIG. 4. The quenching elements 804 are mostly uniform in shape and size, although, as with flame arrestor 600, variations in shape and size are allowable. The quenching elements 804 are generally arranged in a kaleidoscope type fashion similar to flame arrestor 500, but with some wedge-shaped elements replaced by elements resembling flower petals or leaves. Again, the surfaces of each quenching element 804 extend longitudinally through the flame arrestor 400 such that fluid flows through pipe 402 and into pipe 404 through the quenching elements 804.

Flame arrestors 500, 600, 700, and 800 are provided as examples of shapes and arrangements that the quenching elements may take. However, any number of alternative shapes may be utilized in other embodiments of flame arrestors.

In some embodiments, the quenching elements may be arranged in a spiraling shape such that the position of the quenching elements within the conduit varies as a fluid traverses the length of the flame arrestor. However, in many, if not most, applications, such an embodiment is disfavored as it introduces turbulence to the fluid flow which is disfavored in most applications. In most embodiments, the position of each quenching element within the conduit stays relatively the same as the fluid traverses the quenching element such that flow of the fluid through the flame arrestor is not impeded.

FIGS. 9-12 are cross sectional diagrams of flame arrestor 400 showing illustrative embodiments of cooling elements. The cross-sectional views in FIGS. 9-12 are taken at cross section A in FIG. 4.

Figure 9:
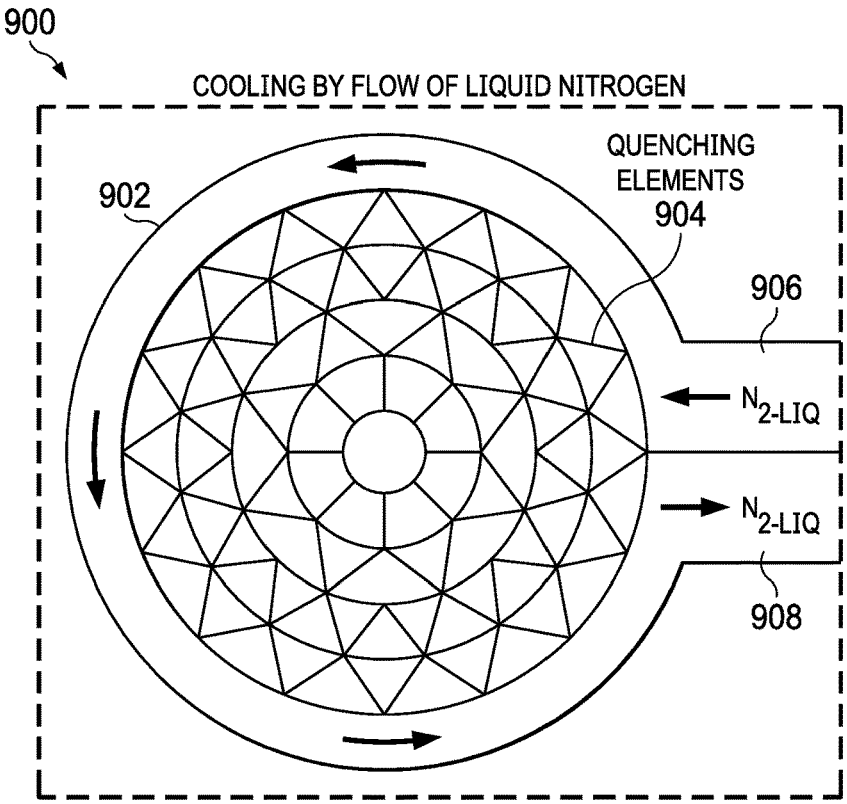
FIGS. 9-12 are illustrations of cross-sectional diagrams of a flame arrestor showing cooling elements in accordance with an illustrative embodiment.

FIG. 9 shows an illustrative embodiment of a flame arrestor 900 using liquid nitrogen to cool the quenching elements. The flame arrestor 900 may be implemented as flame arrestor 400 depicted in FIG. 4. The flame arrestor 900 includes a cooling element 902 and quenching elements 904. The cooling element 902 is a hollow cylinder surrounding the quenching elements 902 which are disposed within an interior of the flame arrestor 900. The cooling element 902 is in thermal contact with the quenching elements 904. The cooling element 902 includes an ingress pathway 906 and egress pathway 908 for liquid nitrogen to flow into a main chamber of the cooling element 902 and around at least portions of the quenching elements 904. In some embodiments, other fluids other than liquid nitrogen are used. An example of another cryogenic fluid is liquid helium. In the depicted embodiment, the cooling element 902 surrounds an outside of the flame arrestor 900 main cavity or a conduit housing the flame arrestor 900. However, in some embodiments, the cooling element 902 may only surround a portion of the flame arrestor 900 main cavity or a conduit housing the flame arrestor 900.

Figure 10:
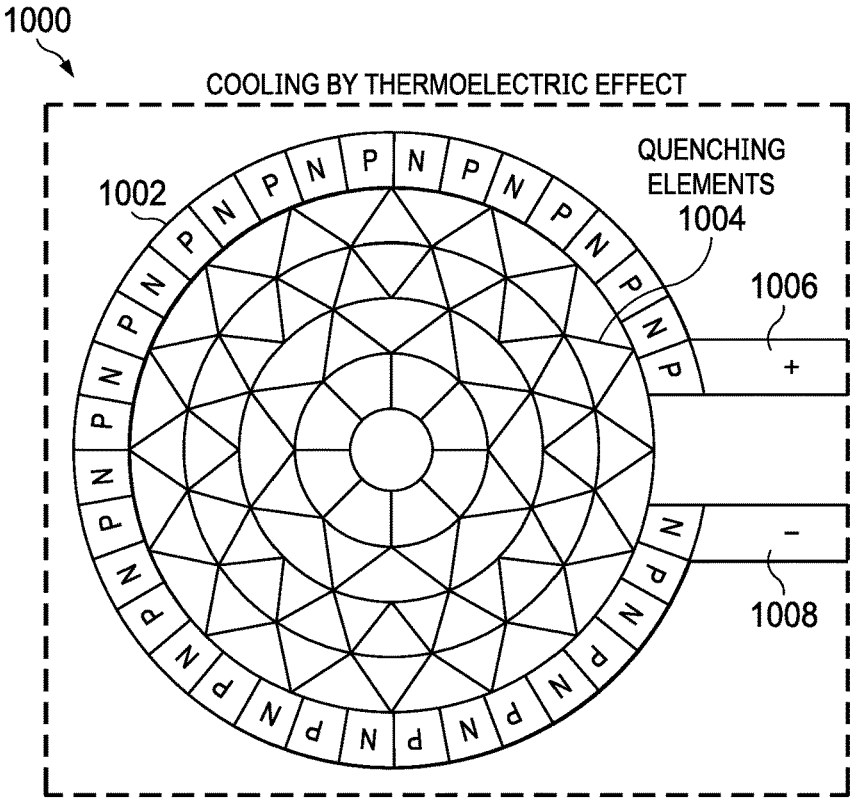

FIG. 10 shows an illustrative embodiment of a flame arrestor 1000 using thermoelectric cooling elements. Flame arrestor 1000 may be implemented as flame arrestor 400 in FIG. 4. Flame arrestor 1000 includes a cooling element 1002 and a plurality of quenching elements 1004. The cooling element 1002 includes a plurality of thermoelectric Peltier coolers surrounding the cavity housing the quenching elements 1004. The Peltier coolers are connected to an electric power supply by positive and negative electrical conduits 1006, 1008. The cooling element may be arranged in multiple different manners similar to the various embodiments described above with respect to FIG. 9.

Figure 11:
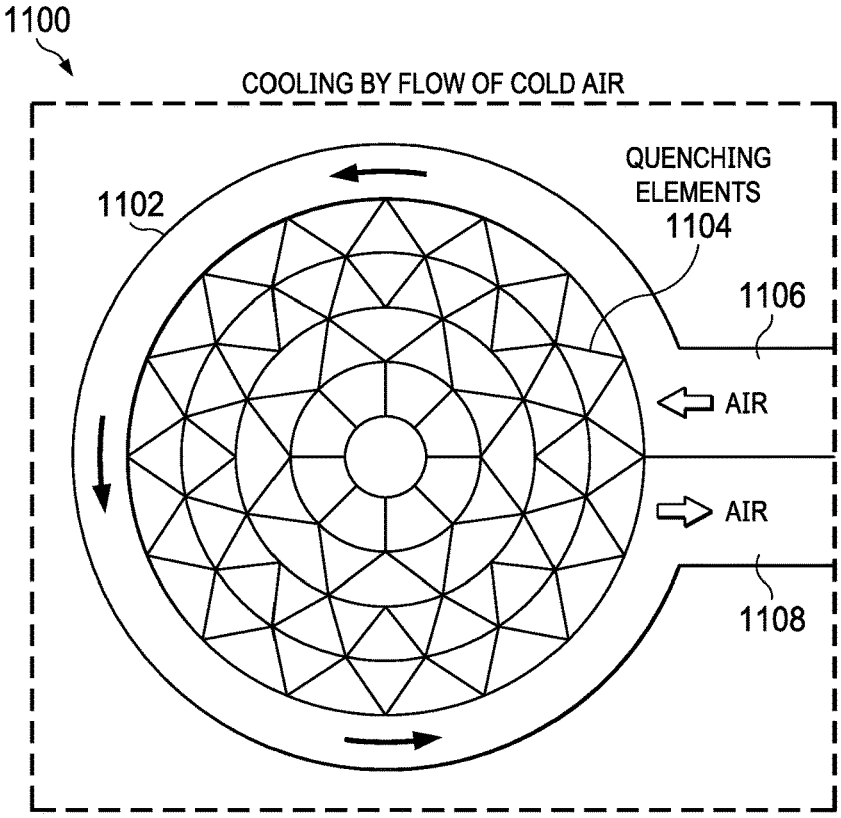

FIG. 11 shows an illustrative embodiment of a flame arrestor 1100 using cold air to cool the quenching elements. The flame arrestor 1100 may be implemented as flame arrestor 400 depicted in FIG. 4. The flame arrestor 1100 is similar to flame arrestor 900 depicted in FIG. 9 and includes a cooling element 1102 and quenching elements 1104. The cooling element 1102 is a hollow cylinder surrounding the quenching elements 1102 which are disposed within an interior of the flame arrestor 1100. The cooling element 1102 is in thermal contact with the quenching elements 1104. The cooling element 1102 includes an ingress pathway 1106 and egress pathway 1108 for cold air to flow into a main chamber of the cooling element 1102 and around at least portions of the quenching elements 1104. In other embodiments, rather than cold air, the fluid flowing through the cooling element 1102 is a chilled noble gas or some other gas or gas mixture. In the depicted embodiment, the cooling element 1102 surrounds an outside of the flame arrestor 1100 main cavity or a conduit housing the flame arrestor 1100. However, in some embodiments, the cooling element 1102 may only surround a portion of the flame arrestor 1100 main cavity or a conduit housing the flame arrestor 1100.

Figure 12:
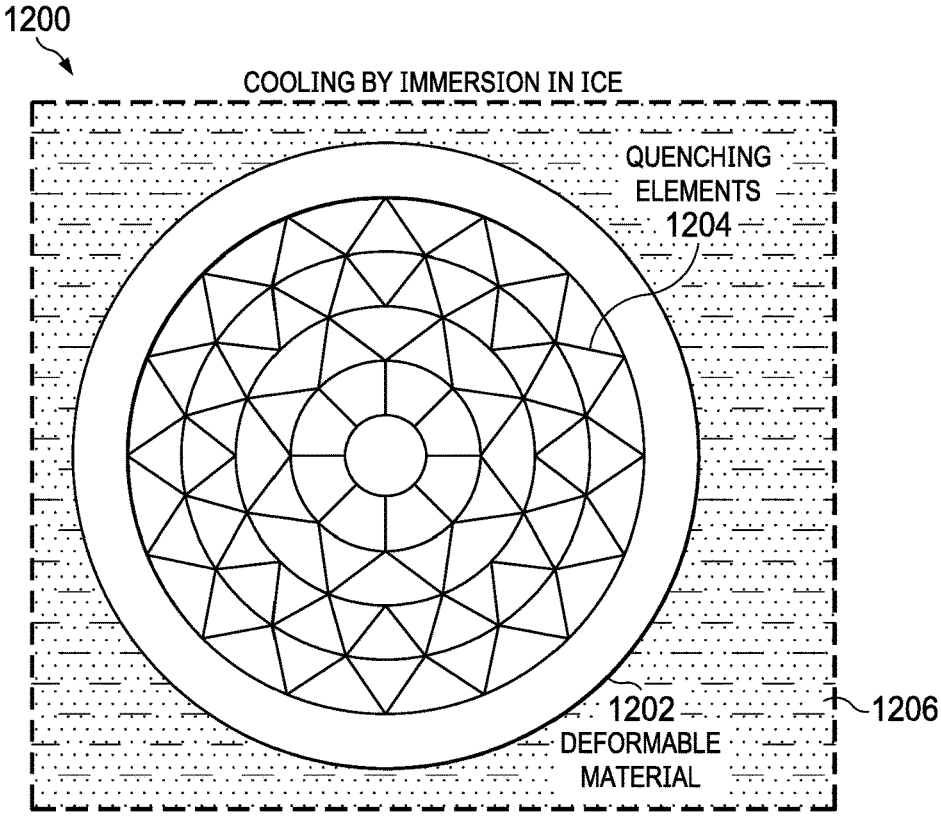

FIG. 12 shows an illustrative embodiment of a flame arrestor 1200 using ice to cool the quenching elements. The flame arrestor 1200 may be implemented as flame arrestor 400 depicted in FIG. 4. The flame arrestor 1200 includes a cooling element 1202 and quenching elements 1204. The cooling element 1202 may be a hollow or solid cylinder surrounding the quenching elements 1202 which are disposed within an interior of the flame arrestor 1200. The cooling element 1202 is in thermal contact with the quenching elements 1204. The cooling element 1202 is surrounded by a cold solid or liquid solid mixture. For example, the cooling element 1202 may be immersed in ice, an ice-water mixture, or dry-ice. In an embodiment, the cooling element 1202 is formed of a deformable material such that expansion or contraction of the ice or other material in which the cooling element 1202 is immersed does not cause damage to the flame arrestor 1200 main body or the conduits. In the depicted embodiment, the cooling element 1202 surrounds an outside of the flame arrestor 1200 main cavity or a conduit housing the flame arrestor 1200. However, in some embodiments, the cooling element 1202 may only surround a portion of the flame arrestor 1200 main cavity or a conduit housing the flame arrestor 1200.

Figure 13:
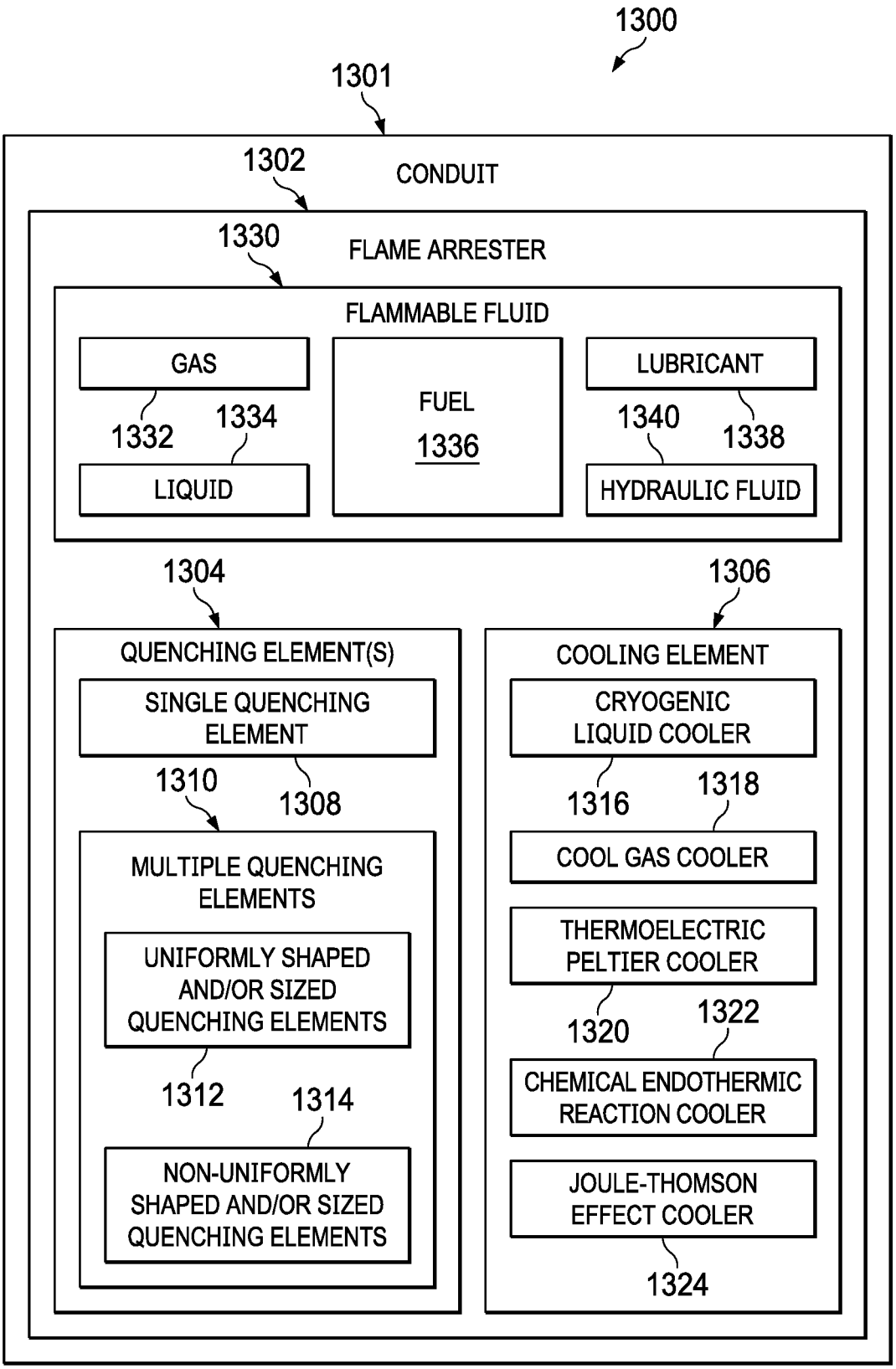
FIG. 13 is an illustration of a block diagram of a flame arrestor system in accordance with an illustrative embodiment.

FIG. 13 is a block diagram showing an illustrative embodiment of a flame arrestor system 1300. Flame arrestor system 1300 includes a conduit 1301 (e.g., a pipe) and a flame arrestor 1302. The flame arrestor 1302 may be integrated into the conduit 1301 or otherwise coupled to it such that flammable fluid 1330 (i.e., combustible fluid) flowing through the conduit 1301 flows through the flame arrestor 1302 before exiting into a different section of the conduit 1301. The flame arrestor 1302 includes one or more quenching element(s) 1304 and a cooling element 1306. In various embodiments, the flammable fluid 1330 may be a gas 1332, a liquid 1334, a fuel 1336, a lubricant 1338, or hydraulic fluid 1340.

The quenching element(s) 1304 may be a single quenching element 1308 or multiple quenching elements 1310. A single quenching element 1308 may be integrated with or be the inner surface of the conduit 1301. The multiple quenching elements 1310 may be uniformly shaped and/or sized quenching elements 1312 or may be non-uniformly shaped and/or sized quenching elements 1314.

The cooling element 1306 may be a cryogenic liquid cooler 1316, a cool gas cooler 1318, a thermoelectric Peltier cooler 1320, a chemical endothermic reaction cooler 1322, or a Joule-Thomson Effect Cooler 1324. In other embodiments, other types of coolers may be implemented as the cooling element 1306.

Figure 14:
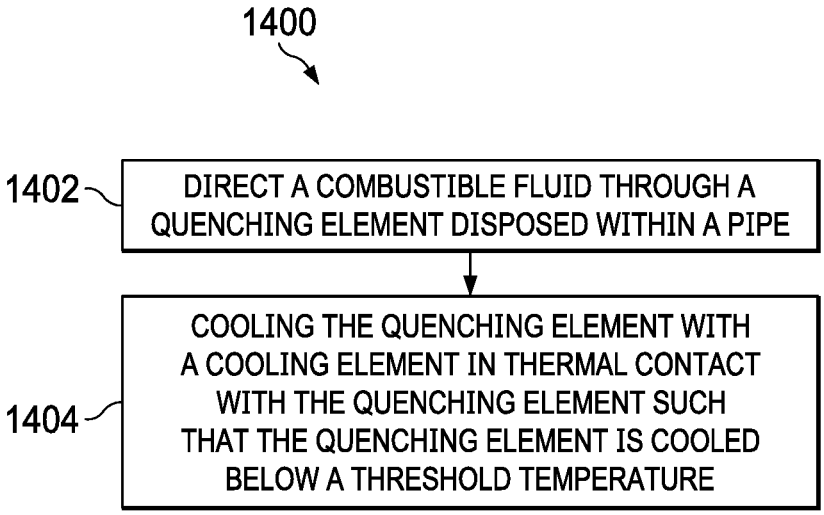
FIG. 14 is an illustration of a block diagram of a flame arresting system in accordance with an illustrative embodiment.

Turning now to FIG. 14, an illustration of a flowchart of a method 1400 for arresting a flame in a conduit is depicted in accordance with an illustrative embodiment. The method 1400 includes directing a combustible fluid through a quenching element disposed within a pipe (step 1402). The method also includes cooling the quenching element with a cooling element in thermal contact with the quenching element such that the quenching element is cooled below a threshold temperature (step 1404).

The flowcharts and block diagrams in the different depicted embodiments illustrate the architecture, functionality, and operation of some possible implementations of apparatus and methods in an illustrative embodiment. In this regard, each block in the flowcharts or block diagrams may represent a module, a segment, a function, and/or a portion of an operation or step.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

Figure 15:
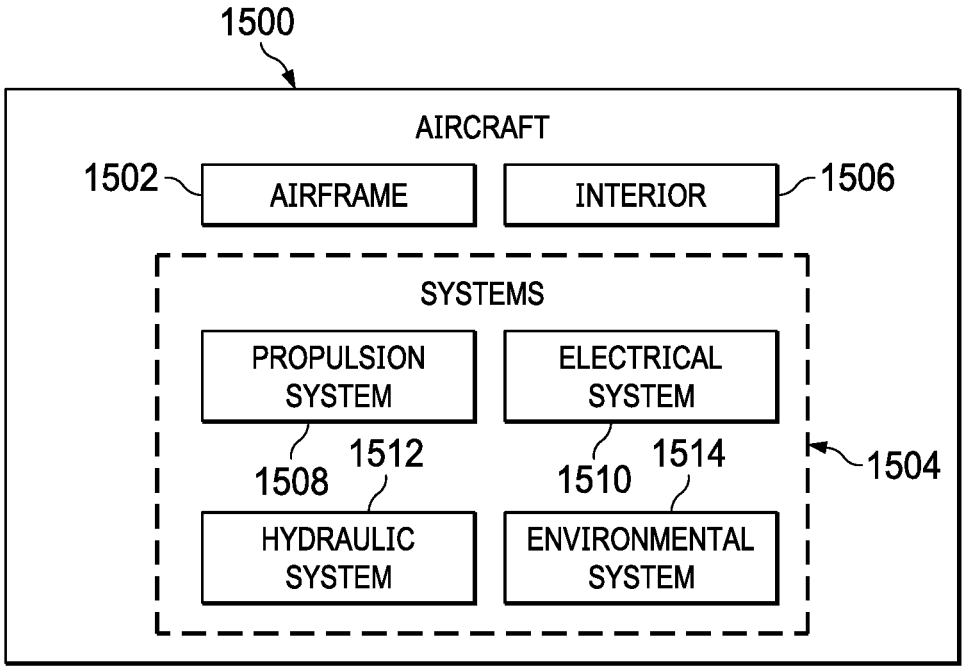
FIG. 15 is an illustration of a block diagram of an aircraft in which an illustrative embodiment may be implemented.

With reference now to FIG. 15, an illustration of an aircraft is depicted in which an illustrative embodiment may be implemented. In this example, aircraft 1500 may include airframe 1502 with plurality of systems 1504 and interior 1506. Examples of systems 1504 include one or more of propulsion system 1508, electrical system 1510, hydraulic system 1512, and environmental system 1514. Any number of other systems may be included. Although an aerospace example is shown, different illustrative embodiments may be applied to other industries, such as the automotive industry.

Apparatuses and methods embodied herein may be employed in one or more components of aircraft 1500.

In some alternative implementations of an illustrative embodiment, the function or functions noted in the blocks may occur out of the order noted in the figures. For example, in some cases, two blocks shown in succession may be performed substantially concurrently, or the blocks may sometimes be performed in the reverse order, depending upon the functionality involved. Also, other blocks may be added in addition to the illustrated blocks in a flowchart or block diagram.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiment. The terminology used herein was chosen to best explain the principles of the embodiment, the practical application or technical improvement over technologies found in the marketplace, or to enable others of ordinary skill in the art to understand the embodiments disclosed here.

What is claimed is:

1. A flame arrestor, comprising:

a quenching element disposed within a container for containing a combustible fluid at a pressure; and a cryogenic cooling system in thermal contact with the quenching element, wherein the cryogenic cooling system comprises a hollow component filled with a cooling fluid comprising one of liquid nitrogen and liquid helium, the hollow component comprising a cooling element conduit, wherein the cooling element conduit provides the cooling fluid to the cryogenic cooling system such that the cooling fluid flows through the cryogenic cooling system to extract heat from the quenching element, wherein the cryogenic cooling system cools the quenching element to a cryogenic temperature and maintains the quenching element at the cryogenic temperature during operation of the cryogenic cooling system;

wherein the quenching element comprises a distance between opposing walls of the quenching element, the distance being smaller than a quenching distance of the combustible fluid when the quenching element is at the cryogenic temperature.

2. The flame arrestor of claim 1, wherein the container comprises one of a conduit and a fuel tank.

3. The flame arrestor of claim 1, wherein the quenching element has a plurality of channels and the distance is between two opposing walls of one channel of the plurality of channels.

4. The flame arrestor of claim 1, wherein the quenching element is a plurality of quenching elements and each quenching element of the plurality of quenching elements extends longitudinally through the flame arrestor.

5. The flame arrestor of claim 1, wherein the cryogenic cooling system is selected from a group consisting of at least one of an active cooling system and a passive cooling system.

6. The flame arrestor of claim 2, wherein the container is a conduit and wherein the conduit is part of a fluid transport system that transports fluids selected from at least one of a fuel, gasoline, kerosene, methane, ethane, propane, butane, ethylene, hydrogen, acetylene, ammonia, carbon monoxide, syngas, ethanol, methanol, propanol, dimethoxyethane (DME), and oxygen.

7. The flame arrestor of claim 1, wherein the quenching element is a plurality of quenching elements and the cooling system comprises a cooling element, wherein the plurality of quenching elements include nonuniform triangular, wedge, and polygonal shaped quenching elements arranged in a kaleidoscope fashion surrounded by the cooling element.

8. The flame arrestor of claim 1, wherein the quenching element is a plurality of quenching elements and the cooling system comprises a cooling element, wherein the plurality of quenching elements include uniform polygonal shaped quenching elements surrounded by the cooling element.

9. The flame arrestor of claim 1, wherein the cooling fluid flows through the hollow component to extract heat from the quenching element.

10. The flame arrestor of claim 1, wherein the cryogenic cooling system surrounds the quenching element.

11. The flame arrestor of claim 1, wherein the cryogenic cooling system is integrated with at least a portion of a wall of the quenching element.

12. A flame arrestor, comprising:

a fluid transport pipe for transporting a combustible fluid from a first point to a second point at a pressure;

a quenching element disposed within an inner volume of the fluid transport pipe, the quenching element comprising a flame arresting material; and a cooling element in thermal contact with the quenching element to cool the quenching element to a cryogenic temperature and maintain the quenching element at the cryogenic temperature during operation of the flame arrestor;

wherein the quenching element comprises a distance between opposing walls of the quenching element, the distance being smaller than a quenching distance of the combustible fluid when the quenching element is at the cryogenic temperature; and wherein the cooling element comprises a hollow component filled with a cooling fluid comprising one of liquid nitrogen and liquid helium, the hollow component comprising a cooling element conduit, wherein the cooling element conduit provides the cooling fluid to the cooling element such that the cooling fluid flows through the cooling element to extract heat from the quenching element and the cooling element conduit provides for the cooling fluid to flow away from the quenching element through a heat exchanger to dissipate heat removed from the quenching element.

13. The flame arrestor of claim 12, wherein the cooling element surrounds the fluid transport pipe.

14. The flame arrestor of claim 12, wherein the cooling element is integrated as at least a portion of a wall of the fluid transport pipe.

15. The flame arrestor of claim 12, wherein the cooling element comprises at least one thermoelectric Peltier cooler.

16. The flame arrestor of claim 12, wherein the cooling element comprises one of a chemical endothermic reaction of two or more chemical agents and a Joule-Thomson effect cooler.

17. The flame arrestor of claim 12, wherein the quenching element has a plurality of channels and the distance is between two opposing walls of one channel of the plurality of channels.

18. The flame arrestor of claim 12, wherein the quenching element is a plurality of quenching elements and each quenching element of the plurality of quenching elements extends longitudinally through the flame arrestor.

19. A vehicle, comprising:

a vehicle frame structure;

a fluid housing conduit within the vehicle frame structure, the fluid housing conduit configured to be at least partially filled with a combustible fluid at a pressure;

a quenching element disposed within an inner chamber of the fluid housing conduit, the quenching element comprising a flame arresting material; and a cooling element thermally coupled to the quenching element to cool the quenching element to a cryogenic temperature and maintain the cryogenic temperature of the quenching element during operation of the vehicle;

wherein the quenching element comprises a distance between opposing walls of the quenching element, the distance being smaller than a quenching distance of the combustible fluid when the quenching element is at the cryogenic temperature; and wherein the cooling element comprises a hollow component filled with a cooling fluid comprising one of liquid nitrogen and liquid helium, the hollow component comprising a cooling element conduit, wherein the cooling element conduit provides the cooling fluid to the cooling element such that the cooling fluid flows through the cooling element to extract heat from the quenching element and the cooling element conduit provides for the cooling fluid to flow away from the quenching element through a heat exchanger to dissipate heat removed from the quenching element.

20. The vehicle of claim 19, wherein the vehicle comprises one of an airplane, a helicopter, a space capsule, a satellite, an automobile, a train, a ship, and a submarine.

* * * * *